United States Patent [19]

Jackson et al.

[11] Patent Number: 4,538,525

[45] Date of Patent: Sep. 3, 1985

[54] FOUR-WHEEL PASSENGER CAR TRUCK

[75] Inventors: Keith L. Jackson, Granite City; James J. Reece, Belleville, both of Ill.

[73] Assignee: Lukens General Industries, Inc., St. Louis, Mo.

[21] Appl. No.: 487,979

[22] Filed: Apr. 25, 1983

[51] Int. Cl.[3] ..... B61D 5/04; B61D 5/30

[52] U.S. Cl. ..... 105/190 R; 105/192; 105/193; 105/208; 105/224.1

[58] Field of Search ..... 105/133, 174, 182 R, 105/185, 190 R, 192, 193, 196, 197 R, 208, 208.2, 199 R, 224.1

[56] References Cited

U.S. PATENT DOCUMENTS

| | | | |
|---|---|---|---|
| 2,330,912 | 10/1943 | Pflager | 105/190 R X |
| 2,488,768 | 11/1949 | Eksergian | 105/190 R |
| 2,559,456 | 7/1951 | Meyer | 105/190 R |
| 2,841,096 | 7/1958 | Hirst | 105/190 R |
| 2,934,028 | 4/1960 | Travilla | 105/190 R |
| 2,956,516 | 10/1960 | Lich | 105/190 R |
| 3,782,294 | 1/1974 | Sundby | 105/190 R |
| 4,237,791 | 12/1980 | Jackson et al. | 105/224.1 X |
| 4,258,629 | 3/1981 | Jackson et al. | 105/224.1 X |

*Primary Examiner*—David A. Scherbel
*Assistant Examiner*—David F. Hubbuch
*Attorney, Agent, or Firm*—F. Travers Burgess

[57] ABSTRACT

A railway vehicle truck has a rigid frame spring-supported at the ends of the frame side members on the journal boxes inboard of the wheels, with the central portion of the frame side members depressed to a lower level than the ends. A pair of center transoms are formed with extensions upwardly and outwardly of the side members adjacent the depressed center portions thereof, the outer extremities of the extensions being positioned outwardly of the wheels and pivotally supporting depending swing hangers. A spring plank supported from the lower ends of the swing hangers extends transversely of the truck through apertures in the depressed center portions of the frame side members, and springs carried by the outer ends of the spring planks support the ends of a bolster which extends outwardly over the frame side members. Longitudinally extending bolster anchors connect each end of the bolster to the corresponding side of the truck frame and a transversely extending spring plank anchor connects the spring plank and the bolster.

6 Claims, 3 Drawing Figures

FOUR-WHEEL PASSENGER CAR TRUCK

BACKGROUND OF THE INVENTION

1. Field of the Invention

The invention relates to railway rolling stock and consists particularly in an inside bearing swing motion truck with wide spacing of the secondary springs.

2. The Prior Art

The concept of an inside bearing rigid frame truck with outside swing hangers for supporting a spring plank, bolster springs and a swing motion bolster is disclosed in H. M. Pflager U.S. Pat. No. 2,330,912. In the patented construction, the truck frame is supported from the journal boxes by equalizers and equalizer springs, with the central portion of the frame side members being at a substantially higher level than the end portions which overlie the journal boxes. The swing hanger clevis brackets extend outwardly transversely only a short distance from the frame side members so that the swing hanger pivots are wholly inboard of the wheels and the truck frame transoms are disaligned longitudinally of the truck a substantial distance from the swing hanger brackets.

SUMMARY OF THE INVENTION

The invention provides a four-wheel swing motion railway truck in which the weight of the truck is minimized by utilizing an inside bearing frame (which also eliminates the need for equalizers and permits the frame to be supported by journal box spring devices without a substantial sacrifice of load equalization capability). Wide spacing of the swing hangers is permitted by extending the center transoms laterally outboard of the frame side members a substantial distance outwardly of the outer plane of the wheels and to a sufficiently high level to permit desirably long swing hangers without exceeding clearance limits. An important safety feature is provided by extending the spring plank through apertures in the depressed central portions of the frame side members so that in the event of swing hanger breakage, the spring plank would be supported by the bottom portion of the adjacent side frame. By depressing the central portion of the frame side members, the bolster is permitted to extend across the top of the side members in the depressed portion while minimizing the overall height of the truck as compared with the Pflager patented truck. By aligning the swing hanger brackets with the transverse transoms, the truck frame transoms and the transom and swing hanger bracket extensions become, in effect, straight transverse beams loaded at their ends by the swing hangers and supported intermediate their ends by the truck frame side members so that the truck frame side members are not required to transmit torsional loads applied to them by the swing hanger brackets from the swing hanger brackets to the transverse transoms.

DETAILED DESCRIPTION OF THE INVENTION

Figure 1:
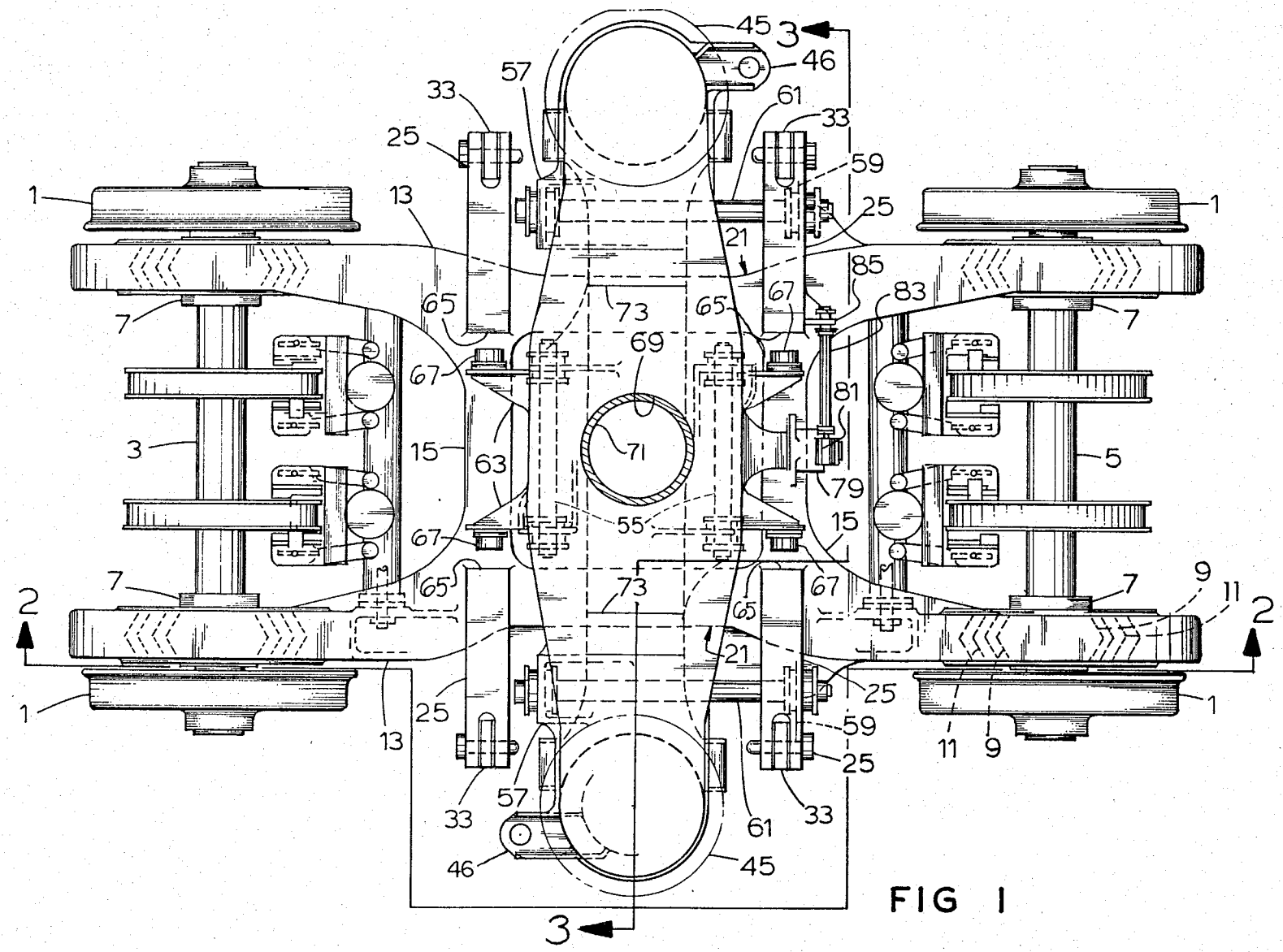
FIG. 1 is a top view of a railway truck constructed in accordance with the invention.
Figure 2:
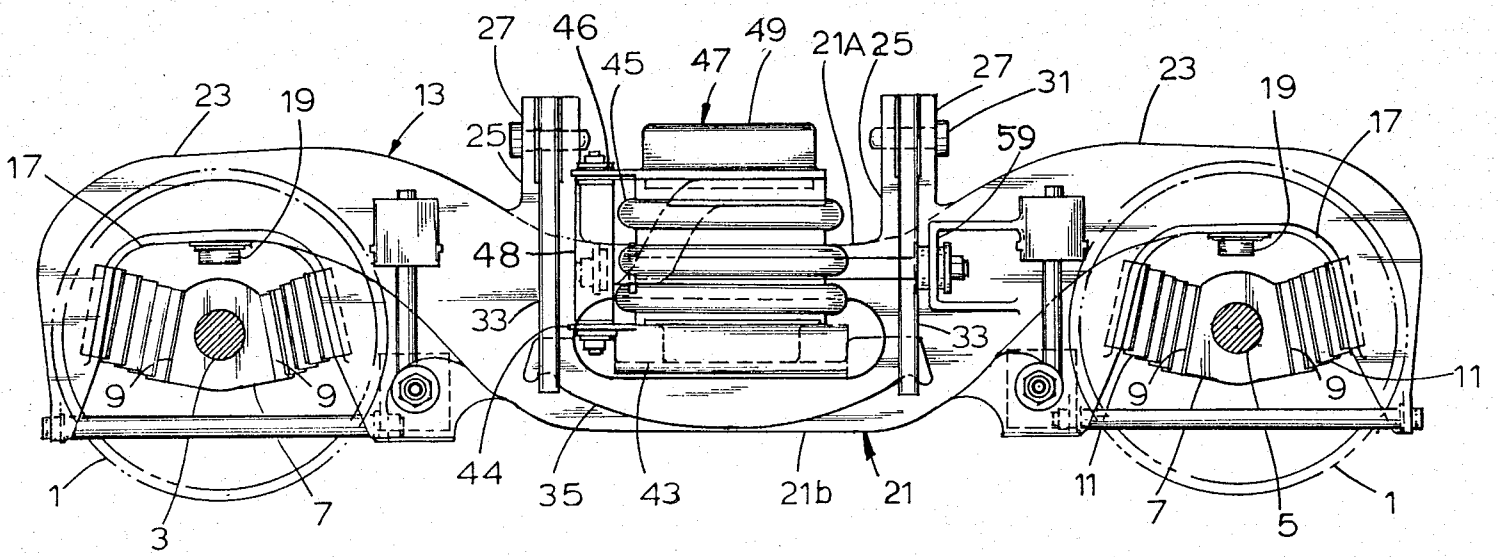
FIG. 2 is a side elevational view of the truck partly sectionalized along line 2—2 of FIG. 1.
Figure 3:
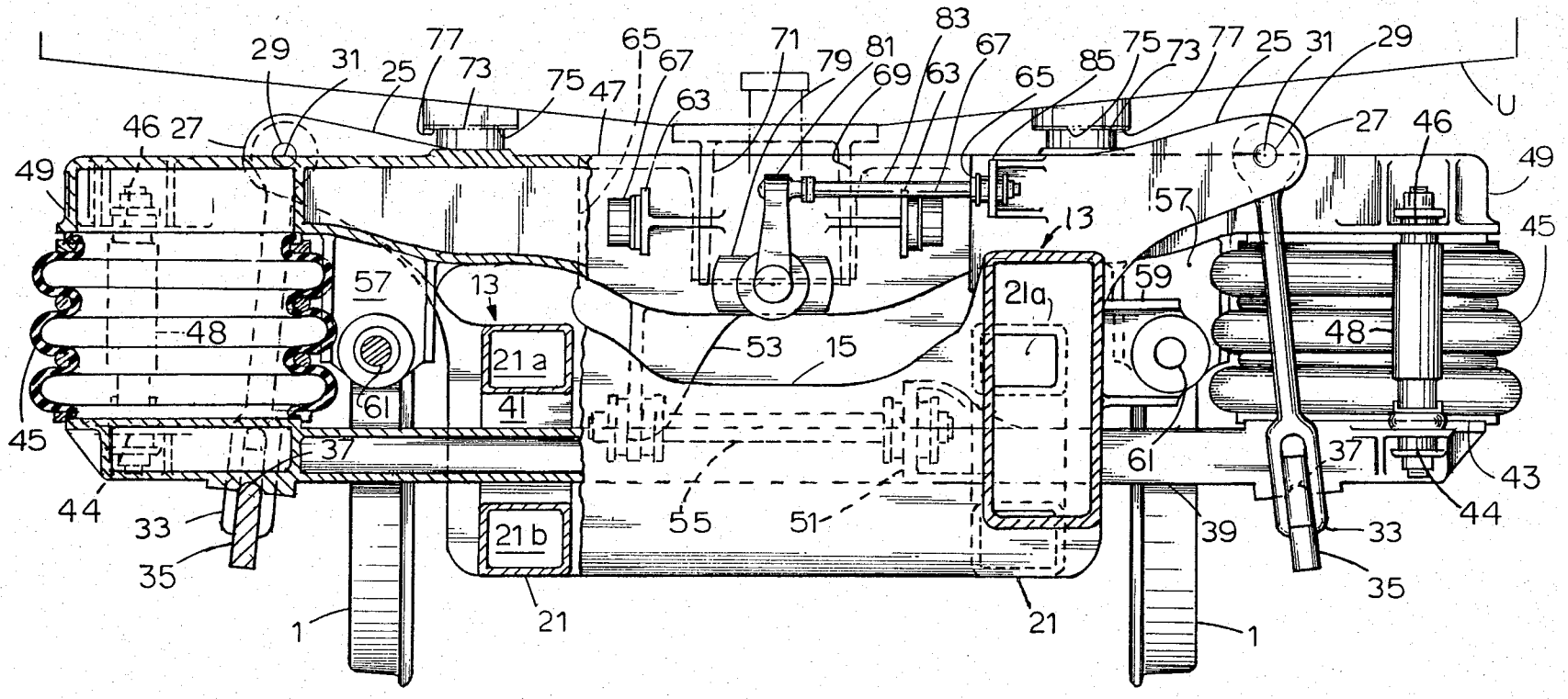
FIG. 3 is a transverse vertical sectional view along line 3—3 of FIG. 1.

The numeral 1 denotes railway wheels mounted in gauged pairs on axles 3 and 5. Inboard of wheels 1, each axle 3 and 5 mounts a journal box 7 which has inwardly and upwardly sloping sides 9 of generally convex V-shape in plan. Elastomeric and metal chevron springs 11 are secured to journal box sides 9.

A truck frame comprising longitudinally extending side members 13 connected to each other intermediate their ends by transverse transom members 15 is formed with downwardly open jaws 17, the sides of which are inclined parallel to those of journal boxes 7 and which are formed with concave V-shaped surfaces to receive the outer surfaces of the chevron spring devices 11, such that the truck frame is resiliently supported on the journal boxes by means of chevron springs 11, which also resist longitudinal and transverse movements of the journal boxes relative to the truck frame. Above each journal box, the respective pedestal jaw 17 mounts a downwardly facing elastomeric pad 19 for resilient engagement with the top of the respective journal box in the event of failure of any of the chevron springs. The intermediate portion 21 of each truck frame side member 13 is depressed to a substantially lower level than the end portions 23, overlying the pedestal jaws 17, and the transverse transoms 15, which intersect the frame side members 13 substantially at the ends of the depressed central portion 21 of each frame side member, are formed in the region of their intersection with the side members with upstanding and transversely outward extensions 25 to form at their ends clevises 27 circularly apertured at 29 to receive swing hanger pivot pins 31, and outwardly inclined swing hangers 33 depend from pivot pins 31.

A swing hanger cross bar 35 is supported from the lower ends of swing hangers 33 and supports, by means of a suitable bearing 37, the end portions of a spring plank 39.

To permit the passage of the spring plank 39 transversely of the truck between opposite swing hanger cross bars the depressed central portions of the truck frame side members 13 are formed with longitudinally elongated apertures 41 defined by upper and lower box section members 21*a* and 21*b*. In the depressed central portions of the frame side members, the frame side members are slightly indented as seen at 21 in FIG. 1 to provide clearance for bolster mounted structure during transverse movements of the bolster. At its ends, partly above and partly outboard of the swing hanger cross bars 35, spring plank 39 is formed with upwardly facing spring seat portions 43 on which are seated flexible wall pneumatic springs 45 and a transverse bolster 47, having downwardly facing spring cap end portions 49 secured to and resting on the tops of pneumatic springs 45, extends over the depressed central portion of the respective frame side members 13 between the upstanding transom extensions 25. Brackets 44 on the spring seat portions 43 of spring plank 39 and similar brackets 46 on the spring cap portion 49 of bolster 47 are connected by vertically acting shock absorbers 48 to dampen vertical oscillations of pneumatic springs 45.

For preventing relative transverse movement between spring plank 39 and bolster 47, spring plank 39 is formed at its side with upstanding brackets 51 and bolster 47 is formed at its sides with depending brackets 53, both brackets 51 and 53 being transversely inboard of the frame side members, and anchor links 55, which may be constructed in accordance with Vernon L. Green Re. 21,987, are connected at their opposite ends to brackets 51 and 53, the limited pivotal connections of the anchor links to the brackets accommodating relative vertical movements between the bolster and the spring plank while causing the bolster to move transversely with the spring plank. For transmitting longitudinal traction and braking forces between bolster 47 and the truck frame, brackets 57 depend from one side of the bolster at both sides of the truck slightly inboard of pneumatic spring devices 45 and outboard of the respective truck frame side members 13, and similar brackets 59, aligned longitudinally of the truck with the respective brackets 57, project transversely outwardly from truck frame side members 13 beneath the transverse extensions 25 adjoining the opposite side of the bolster, and at each side of the truck, a longitudinally extending bolster anchor link 61 which also may be constructed in accordance with Vernon L. Green Re. 21,987 is connected at its respective ends to brackets 57 and 59, the limiting pivotal connection of anchor links 61 with respect to the brackets 57 and 59 permitting relative transverse and vertical movements of the bolster with respect to the truck frame while transmitting longitudinal traction and braking forces therebetween. For limiting relative transverse movement of bolster 47 with respect to the truck frame, bolster 47 is formed at its sides with brackets 63 which are aligned with the inner vertical surfaces 65 of transom extensions 25 and elastomeric bumper blocks 67 are secured to brackets 63 for abutting engagement with inboard vertical surfaces 65 of transom extensions 25 when the desired limit of transverse bolster movement is approached.

For supporting car underframe structure U on the truck and permitting swivel of the truck about its center, bolster 47 is formed with a cylindrical recess 69 at its center and a cylindrical element 71 secured to the bottom of underframe structure U at its transverse center is rotatably received in bolster recess 69. For supporting the underframe structure U on the bolster, the bolster is formed with upwardly facing side bearings 73 spaced apart transversely of the truck approximately as far as the outer vertical surfaces of the truck frame side members 13, and downwardly facing body side bearings 75 are secured to the bottom of underframe structure U and are in slidable relation with truck side bearings 73 to accommodate swivel of the truck about the axis of mating recess 69 and cylindrical element 71, the entire vertical load of the body being carried by side bearings 73 and 75. Body side bearings 75 may be faced with material as at 77, to provide frictional resistance adequate to dampen oscillations of the truck about the swivel axis without interference with truck swivel on curved track.

For damping transverse movements of the bolster accommodated through swinging of swing hangers 33, a rotary shock absorber 79 mounted on one side of the bolster has its arm 81 connected by a transversely extending pitman 83 to a bracket 85 on the upstanding portion of one of the transom extensions 25.

The truck may incorporate any suitable braking arrangement. For illustrative purposes a disc brake arrangement is shown, comprising a pair of discs 87 mounted on each axle, with accompanying mechanisms 89 supported on transverse beams 91 secured at their ends to the frame side members 13 longitudinally inboard from the respective axles 3 and 5.

Operation of the truck is as follows: As a car equipped with a pair of the trucks incorporating the invention is moved along a track, the axles are held against substantial lateral and longitudinal movement with respect to the truck frame by the chevron springs 11, which accommodate vertical movements between the journal boxes and the adjacent portions of the frame side members 13 to cushion the truck frame against vertical shocks received by the wheels from vertical irregularities in the rails and to provide load equalization between the wheels, without the necessity for longitudinally extending equalizers because the axles act as equalizers extending transversely of the truck and the relatively short spacing apart of the journal boxes on each axle eliminates severe diagonal loading of the truck frame as would occur with outside journals. The transmission of lateral shocks to the car body from lateral irregularities in the rails is reduced by the lateral motion of the spring plank, bolster and body relative to the truck frame permitted by the relatively long swing hangers, and tendencies of the body to roll in the transverse plane are opposed by the relatively large roll resisting moment resulting from the wide spacing of the swing hangers and the consequent wide transverse spacing of pneumatic springs 45. In the event of failure of any of the swing hanger pivot pins, the swing hangers or the swing hanger cross bars, the underlying relationship of the bottom members *21b* of the frame side members and the spring plank will prevent the spring plank from dropping to the rails and will also offer support for the bolster and car body.

The details of the truck described herein may be varied substantially without departing from the spirit of the invention and the exclusive use of such modifications as come within the scope of the appended claims is contemplated.

We claim:

1. In a railway vehicle truck, a pair of axles spaced apart longitudinally of the truck from each other and each mounting a gauged pair of flanged railway wheels, a truck frame comprising a pair of transversely spaced longitudinally extending side members each having end portions positioned above the axles and resiliently supported thereon transversely inboard of said wheels and a central portion depressed to a lower level than said end portions and a pair of longitudinally spaced transversely extending transom members rigidly connected to said side members adjacent the depressed center portion thereof and being formed with upward and outward extensions projecting above said side members and outwardly therefrom a substantially greater distance than the outer surfaces of said wheels, the outer extremities of said extensions being formed as clevises, depending transversely swingable hangers pivotally mounted in said clevices, said side members being formed with a longitudinally elongated aperture in their depressed portions, a transversely extending spring plank passing through said apertures and being supported near its ends from said swing hangers, upright spring devices supported on the ends of said spring plank, a transversely extending bolster carried at its ends on said upright spring devices and extending over the depressed center portion of said side members, and means preventing substantial movements of said bolster longitudinally of the truck with respect to said truck frame while accommodating lateral and vertical movements therebetween as permitted by said swing hangers and upright spring devices, and means connecting said bolster and said spring plank to each other to prevent substantial transverse movements therebetween while accommodating vertical movements permitted by said upright spring devices.

2. In a railway vehicle truck according to claim 1, said side member central portions being recessed transversely inwardly from said end portions, said longitudinal movement preventing means comprising a longitudinally extending anchor link positioned beneath said bolster and between the spring device and the central portion of the frame side member at each side of the truck, one end of each said anchor link being connected to one side of said bolster and the other end of said anchor link being connected to the respective truck frame side members near the opposite side of said bolster.

3. In a railway vehicle truck according to claim 2, the end portions of said frame side members forming downwardly open jaws, said axles mounting journal bearing devices inboard of the respective wheels, said journal bearing devices being received within said jaws for vertical movement therein, and resilient means carried by said journal bearing devices and supporting said frame side members for vertical movement on said journal bearing devices.

4. In a railway vehicle truck according to claim 3, said journal bearing devices having sloping sides of V-shape in plan, said resilient means comprising elastomeric and metal chevron devices seated on said journal bearing devices sloping sides, said jaw portions of said truck frame side member being formed with V-shaped sloping recesses to receive said chevron spring devices.

5. In a railway vehicle truck according to claim 1, said bolster having means for swivelly supporting a railway vehicle body.

6. In a railway vehicle truck according to claim 5, said body supporting means comprising a pivot bearing at the center of said bolster and side bearings on said bolster spaced transversely of the truck from each other.

* * * * *